US010808363B2

(12) United States Patent
Hechenberger

(10) Patent No.: US 10,808,363 B2
(45) Date of Patent: Oct. 20, 2020

(54) MAINTENANCE VEHICLE

(71) Applicant: ROBEL BAHNBAUMASCHINEN GMBH, Freilassing (DE)

(72) Inventor: Peter Hechenberger, Kirchdorf (AT)

(73) Assignee: Robel Bahnbaumaschinen GmbH, Freilassing (DE)

( * ) Notice: Subject to any disclaimer, the term of this patent is extended or adjusted under 35 U.S.C. 154(b) by 281 days.

(21) Appl. No.: 16/068,140

(22) PCT Filed: Dec. 22, 2016

(86) PCT No.: PCT/EP2016/002171

§ 371 (c)(1),
(2) Date: Jul. 5, 2018

(87) PCT Pub. No.: WO2017/129214

PCT Pub. Date: Aug. 3, 2017

(65) Prior Publication Data

US 2019/0010666 A1 Jan. 10, 2019

(30) Foreign Application Priority Data

Jan. 27, 2016 (DE) ..... 20 2016 000 509 U

(51) Int. Cl.

| | |
|---|---|
| ***E01B 29/16*** | (2006.01) |
| ***E01B 29/00*** | (2006.01) |
| ***B61D 15/00*** | (2006.01) |
| ***B66C 23/50*** | (2006.01) |
| ***B61D 15/02*** | (2006.01) |

(52) U.S. Cl.
CPC ..... *E01B 29/16* (2013.01); *B61D 15/00* (2013.01); *B61D 15/02* (2013.01); *B66C 23/50* (2013.01); *E01B 29/00* (2013.01)

(58) Field of Classification Search
CPC ..... B61D 15/00; B61D 15/02; E01B 29/00; E01B 29/16; B66C 23/50
See application file for complete search history.

(56) References Cited

U.S. PATENT DOCUMENTS 4,133,266 A * 1/1979 Taylor ..... E01B 29/10 104/6
4,261,264 A * 4/1981 Theurer ..... E01B 29/06 104/2

(Continued)

FOREIGN PATENT DOCUMENTS

AU 2005282006 B2 3/2006
AU 2011260627 B2 12/2011

(Continued)

*Primary Examiner* — Zachary L Kuhfuss
(74) *Attorney, Agent, or Firm* — Laurence A. Greenberg; Werner H. Stemer; Ralph E. Locher

(57) ABSTRACT

A maintenance vehicle has a vehicle frame, supported on on-track undercarriages, on which are arranged two side walls extending in a longitudinal direction of the vehicle and adjustable with respect to one another and relative to the vehicle frame in a transverse direction of the vehicle by way of drives. The vehicle is equipped with at least one load crane which is displaceable on a crane guide that extends in the transverse direction of the vehicle. The crane guide, designed to be elongatable in the transverse direction of the vehicle, is connected at each end to a side wall.

6 Claims, 1 Drawing Sheet

(56) References Cited

U.S. PATENT DOCUMENTS

| | | | | |
|---|---|---|---|---|
| 7,370,586 | B2 * | 5/2008 | McHale | E01B 29/16 104/2 |
| 7,472,654 | B2 * | 1/2009 | Davies | B66C 23/50 104/3 |
| 8,297,194 | B2 * | 10/2012 | Theurer | B66C 23/50 104/2 |
| 2019/0010666 | A1 * | 1/2019 | Hechenberger | B61D 15/00 |

FOREIGN PATENT DOCUMENTS

| | | | |
|---|---|---|---|
| DE | 202004013732 | U1 | 1/2005 |
| DE | 202009014493 | U1 | 3/2010 |
| DE | 102009033516 | A1 | 4/2011 |
| DE | 102010022679 | A1 | 12/2011 |
| EP | 1502993 | A2 | 2/2005 |
| EP | 2374683 | A2 | 10/2011 |
| WO | 2006027030 | A1 | 3/2006 |

* cited by examiner

Fig. 1
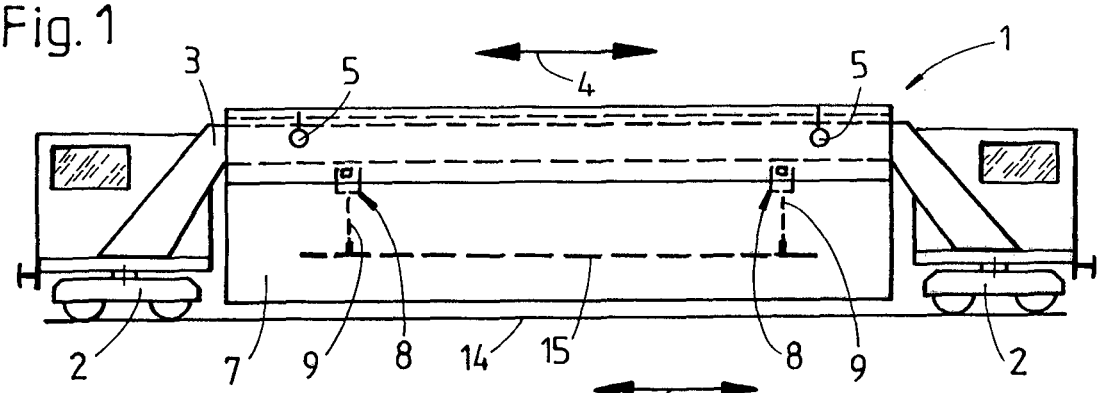
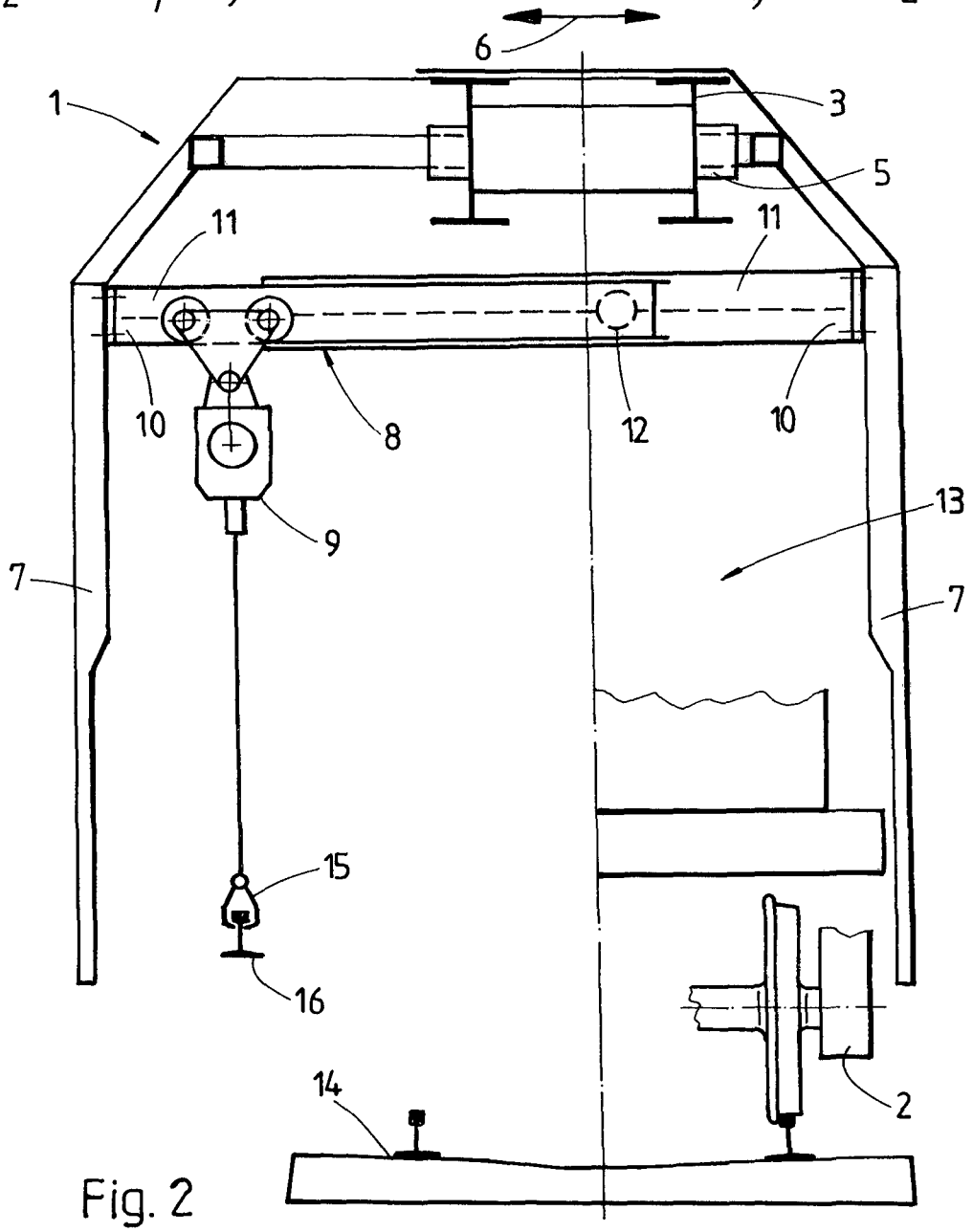
Fig. 2

MAINTENANCE VEHICLE

BACKGROUND OF THE INVENTION

Field of the Invention

The invention relates to a maintenance vehicle having a vehicle frame, supported on on-track undercarriages, on which are arranged two side walls extending in a longitudinal direction of the vehicle and adjustable with respect to one another and relative to the vehicle frame in a transverse direction of the vehicle by means of drives, and also having at least one load crane displaceable on a crane guide extending in the transverse direction of the vehicle.

Vehicles of this type, mobile on a track, are already known from WO 2006/027030 A1 or DE 102010022679 A1. Arranged on the frame of the vehicle is a load crane adjustable in the longitudinal and transverse direction of the vehicle. This load crane is utilized in a space, delimited by side walls adjustable in the transverse direction of the vehicle, to transport and position track parts or machines to work on the track.

SUMMARY OF THE INVENTION

It is the object of the present invention to provide a maintenance vehicle of the kind mentioned at the beginning, the load crane of which is ready for operation within a short time without special preparations.

According to the invention, this object is achieved with a maintenance vehicle of the specified type in that the crane guide, designed to be elongatable in the transverse direction of the vehicle, is connected at each end to a side wall.

With a crane guide being designed in this manner, the same is automatically adjusted to the construction site situation. Simultaneously with positioning the side walls, the crane guide is adjusted in the transverse direction of the vehicle, and the load crane can immediately be moved and employed.

Additional advantages of the invention become apparent from the dependent claims and the drawing description.

BRIEF DESCRIPTION OF THE SEVERAL VIEWS OF THE DRAWING

The invention will be described in more detail below with reference to an embodiment represented in the drawing.

FIG. 1 shows a schematic side view of a maintenance vehicle, and

FIG. 2 shows an enlarged view of the vehicle in the longitudinal direction of the vehicle.

DESCRIPTION OF THE INVENTION

A maintenance vehicle 1 shown in FIGS. 1 and 2 consists essentially of a vehicle frame 3 supported on on-track undercarriages 2. Arranged on said vehicle frame 3 are two side walls 7 which extend in a longitudinal direction 4 of the vehicle and are adjustable with respect to one another and relative to the vehicle frame 3 in a transverse direction 6 of the vehicle by means of drives 5. The vehicle 1 has at least one load crane 9 displaceable on a crane guide 8 extending in the transverse direction 6 of the vehicle. The crane guide 8, designed to be elongatable in the transverse direction 6 of the vehicle, is connected at each end 10 to a side wall 7. It is advantageous to arrange two crane guides 8 and load cranes 9 spaced from one another in the longitudinal direction 4 of the vehicle.

As can be seen particularly in FIG. 2, the crane guide 8 is designed to be telescopically elongatable and consists of two beams 11 connected to one another. The load crane 9 is designed to be adjustable in the transverse direction 6 of the vehicle by means of a schematically shown drive 12.

The operation of the maintenance vehicle 1 will now be described briefly: After the vehicle 1 has been moved to the construction site, one or both side walls 7 are adjusted in the transverse direction 6 of the vehicle by actuation of the drives 5. A space 13 is thus created in which personnel can stay—protected from weather and from inadvertently entering a neighbouring track—to work on a track 14.

Simultaneously with the side walls 7, the crane guide 8 is elongated and the beams 11 are pushed away from one another in the transverse direction 6 of the vehicle. Without any further preparatory measures, the load crane 9 can now be moved over the entire width of the space 13. Thus it is possible, for example, to lower machines or tools located on a load take-up means 15 arranged on the load crane 9, and to position these above the track 14 to be worked on. If two load cranes 9 are provided, longer rails 16 also can be installed or removed. To that end, each load crane 9 is equipped with a load take-up means 15 designed as rail tongs. Positioning the rail 16 with respect to the longitudinal direction 4 of the vehicle takes place by slow movement of the vehicle 1. After work is finished, the beams of the crane guide 8 together with the side walls 7 are pushed towards one another again in the transverse direction 6 of the track by actuation of the drives 5.

The invention claimed is:

1. A maintenance vehicle, comprising:

a vehicle frame supported on on-track undercarriages;

two side walls disposed on said frame and extending in a longitudinal direction of the vehicle and adjustably mounted with respect to one another and relative to said vehicle frame in a transverse direction of the vehicle;

drives configured to adjust said side walls in the transverse direction;

a crane guide extending in the transverse direction of the vehicle, said crane guide having ends connected to each of said side walls and being elongatable in the transverse direction of the vehicle; and at least one load crane displaceably disposed on said crane guide.

2. The maintenance vehicle according to claim 1, wherein said crane guide is one of two crane guides spaced from one another in the longitudinal direction of the vehicle, and said at least one load crane is one of two load cranes respectively supported on said crane guides.

3. The maintenance vehicle according to claim 2, wherein each of said crane guides is telescopically elongatable and is formed with two beams that are connected to one another.

4. The maintenance vehicle according to claim 2, comprising a respective drive assigned to each of said load cranes for adjustably moving said load cranes in the transverse direction of the vehicle.

5. The maintenance vehicle according to claim 1, wherein said crane guide is telescopically elongatable and is formed with two beams that are connected to one another.

6. The maintenance vehicle according to claim 1, comprising a drive configured to adjustably move said load crane in the transverse direction of the vehicle.

* * * * *